US007997759B2

(12) United States Patent
Feinbloom et al.

(10) Patent No.: US 7,997,759 B2
(45) **Date of Patent: *Aug. 16, 2011**

(54) ILLUMINATION DEVICE

(75) Inventors: Richard E Feinbloom, New York, NY (US); Kenneth Braganca, Ronkonkoma, NY (US); Peter Yan, Rego Park, NY (US); Michael Botta, Mannorville, NY (US)

(73) Assignee: Designs For Vision, Inc., Ronkonkoma, NY (US)

( * ) Notice: Subject to any disclaimer, the term of this patent is extended or adjusted under 35 U.S.C. 154(b) by 198 days.

This patent is subject to a terminal disclaimer.

(21) Appl. No.: 12/321,520

(22) Filed: Jan. 22, 2009

(65) Prior Publication Data

US 2009/0219717 A1 Sep. 3, 2009

Related U.S. Application Data

(63) Continuation-in-part of application No. 12/148,820, filed on Apr. 23, 2008, now Pat. No. 7,682,042, which is a continuation-in-part of application No. 12/074,370, filed on Mar. 3, 2008, now Pat. No. 7,690,806.

(51) Int. Cl.
*F21V 1/00* (2006.01)

(52) U.S. Cl. ..... 362/239; 362/238; 362/240; 362/235; 362/318

(58) Field of Classification Search ..... 362/249.1, 362/277, 249.03, 249.07, 249.11, 572, 238, 362/240

See application file for complete search history.

(56) References Cited

U.S. PATENT DOCUMENTS

| | | | |
|---|---|---|---|
| 2,659,824 | A | 11/1953 | Bumham |
| 3,360,640 | A | 12/1967 | Seitz |
| 4,581,689 | A | 4/1986 | Oram |
| 5,383,105 | A | 1/1995 | Agut |
| 5,408,393 | A | 4/1995 | Becker |
| 5,440,462 | A | 8/1995 | Kim |
| 5,722,762 | A | 3/1998 | Soll |
| 6,120,164 | A | 9/2000 | Libin |
| 6,290,368 | B1 | 9/2001 | Lehrer |

(Continued)

OTHER PUBLICATIONS

Zeon LED Portable High Definition Light System, Website print-out from www.orascoptic.com (Mar. 2007) (2 pages).

*Primary Examiner* — Ali Alavi
(74) *Attorney, Agent, or Firm* — Plevy & Keene LLP

(57) ABSTRACT

Disclosed is an illumination device for projecting a substantially uniform light at a remote distance. The illumination device comprises a mounting assembly divided into a plurality of sections, each section comprising a plurality of light emitting sources arranged substantially equidistant along a circumference of the assembly to project a light substantially perpendicular to the assembly, an contact plate connected via a central axis with, and fixed to, the mounting assembly, the contact plate providing an electrical contact to each of the light emitting devices, a plurality of lensing assemblies equal in number to the plurality of sections axially aligned with the mounting assembly, the lensing assembly aligned with a select one of the light emitting sources in a corresponding section, the light emitting source being positioned in front of a focal point of the lensing assembly, each lensing assembly comprising at least one optically transparent lens determining the lensing assembly focal point wherein the lensing assembly is oriented at a known angle with regard to the light projected from the light source, and means for shifting the contact plate and mounting assembly to align a select one of said light emitting devices with a corresponding lensing assembly.

17 Claims, 8 Drawing Sheets

U.S. PATENT DOCUMENTS

| | | | | |
|---|---|---|---|---|
| 6,390,640 | B1 | 5/2002 | Wong | |
| 6,461,024 | B1 | 10/2002 | Becker | |
| 6,585,395 | B2 | 7/2003 | Luk | |
| 6,866,410 | B2 | 3/2005 | Jesurun | |
| 6,877,875 | B2 | 4/2005 | Yu | |
| 6,955,444 | B2 | 10/2005 | Gupta | |
| 7,131,753 | B1 | 11/2006 | Edwards | |
| 7,682,042 | B2 * | 3/2010 | Feinbloom et al. | 362/249.03 |
| 2004/0264175 | A1 | 12/2004 | Willoughby | |
| 2005/0099824 | A1 | 5/2005 | Dowling | |

* cited by examiner

Proposed

ILLUMINATION DEVICE

CLAIM OF PRIORITY

This application claims the benefit of the earlier filing date, pursuant to 35 USC §120, as a Continuation-in-Part, to that patent entitled, "Illumination Device," filed in the US Patent Office on Apr. 23, 2008 and afforded Ser. No. 12/148,820, now U.S. Pat. No. 7,682,042, which is related to commonly-owned, patent application entitled "Illuminating Headlamp Providing Substantially Uniform Illumination," filed in the U.S. Patent And Trademark Office on Mar. 3, 2008 and afforded Ser. No. 12/074,370, now U.S. Pat. No. 7,690,806, the contents of which are incorporated by reference, herein.

FIELD OF THE INVENTION

This invention is in the field of illumination devices and more particularly to a multi-LED over-head projection device.

Illumination devices are employed in a wide variety of fields and applications. In the medical and dental fields illumination devices are employed in connection with illumination of tissues, teeth, and other materials. In dentistry, halogen bulbs have been employed for illumination of teeth and gum. Halogen lights have a color temperature of between about 3200° Kelvin (K) to about 4700° K.

A disadvantage of halogen illumination is that the color temperature is substantially constant and different color temperatures are desirable for different purposes. For example, a color temperature in the order of 5800° K. is desirable for surgical procedures and other dental work, while a color temperature in the order of 6800° K. is desirable for color matching. In the examination of gums, a color temperature of between about 3200° K. and 4700° K. is desirable. Halogen illumination is generally used for this purpose. In order area of dentistry also different illuminations and different wavelengths are used for specific operations. For example to cure ultraviolet adhesives a light having wavelength between about 400 nanometers (nm) and about 500 nm is required. Blue lights, at a wavelength of about 430 nm, have been successfully used to detect oral cancers. Avoiding inadvertent curing of ultraviolet curable adhesives requires avoiding illumination at wavelengths of less than about 550 nm.

Accordingly, current illumination technology requires that in the field of dentistry a plurality of different light sources are required for proper illumination. This is both expensive and requires considerable floor space.

Hence, there is a need in the industry for a compact, low-cost illumination device that is suitable for projecting a desired color or temperature illumination onto a desired location.

SUMMARY OF THE INVENTION

Disclosed is an illumination device for projecting a substantially uniform light at a remote distance. The illumination device comprises a mounting assembly divided into a plurality of sections, each section comprising a plurality of light emitting sources arranged substantially equidistant along a circumference of the assembly to project a light substantially perpendicular to the assembly, an contact plate connected via a central axis with, and fixed to, the mounting assembly, the contact plate providing an electrical contact to each of the light emitting devices, a plurality of lensing assemblies equal in number to the plurality of sections axially aligned with the mounting assembly, the lensing assembly aligned with a select one of the light emitting sources in a corresponding section, the light emitting source being positioned in front of a focal point of the lensing assembly, each lensing assembly comprising at least one optically transparent lens determining the lensing assembly focal point wherein the lensing assembly is oriented at a known angle with regard to the light projected from the light source, and means for shifting the contact plate and mounting assembly to align a select one of said light emitting devices with a corresponding lensing assembly. In present invention, the light sources are flush mounted to the plate to project a light substantially perpendicular to the plate and the optical axis of the lensing assemblies are oriented with respect to the direction of the light source to project the light emitted from the light at a desired point.

Figure 1:
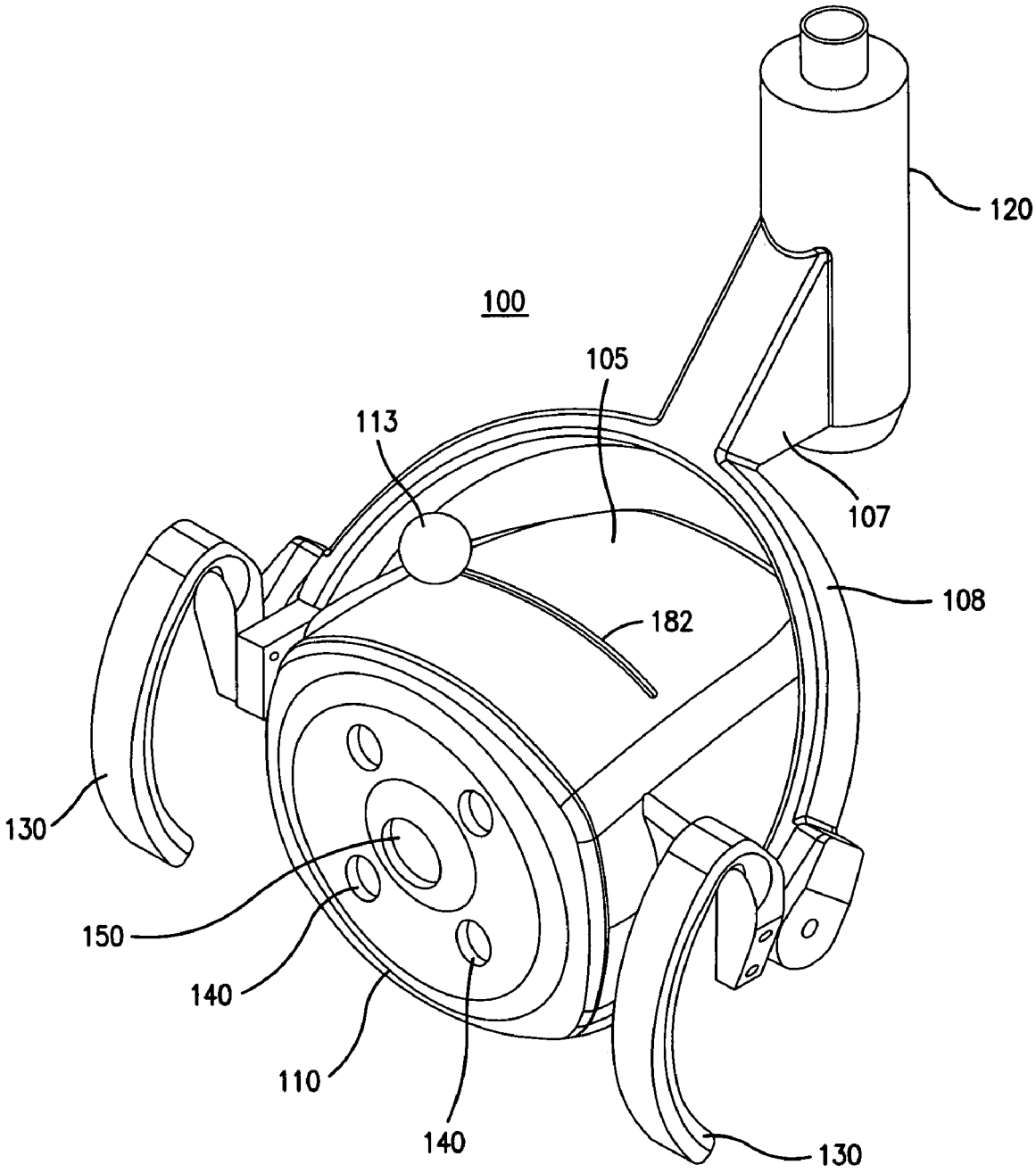
FIG. 1 is a perspective view of an illumination device according to a first embodiment of the invention.

It is to be understood that these drawings are solely for purposes of illustrating the concepts of the invention and are not intended as a definition of the limits of the invention. The embodiments shown in the figures herein and described in the accompanying detailed description are to be used as illustrative embodiments and should not be construed as the only manner of practicing the invention. Also, the same reference numerals, possibly supplemented with reference characters where appropriate, have been used to identify similar elements.

DETAILED DESCRIPTION

FIG. 1 illustrates an illumination device 100 in accordance with the principles of invention. Illumination device 100 generally has housing 105 and support post 120, onto which device 100 is adjustably supported via arm 107 and semicircular bracket 108. Support post 120 may carry one or more power supply cables and one or more data lines (not shown). Post 120 may be fixed to an item of furniture, a structural member, a wall, ceiling or other rigid support or may be suspended on a movable frame. Handles 130 are fixed to housing 105 and permit adjustment of the position of housing 105. Front cover 110 has multiple ports 140, 150 therein, through which light may be transmitted. Port 150 is positioned along a central axis of illumination device 100, while ports 140 are oriented substantially symmetrically about the central axis of illumination device 100.

Figure 2:
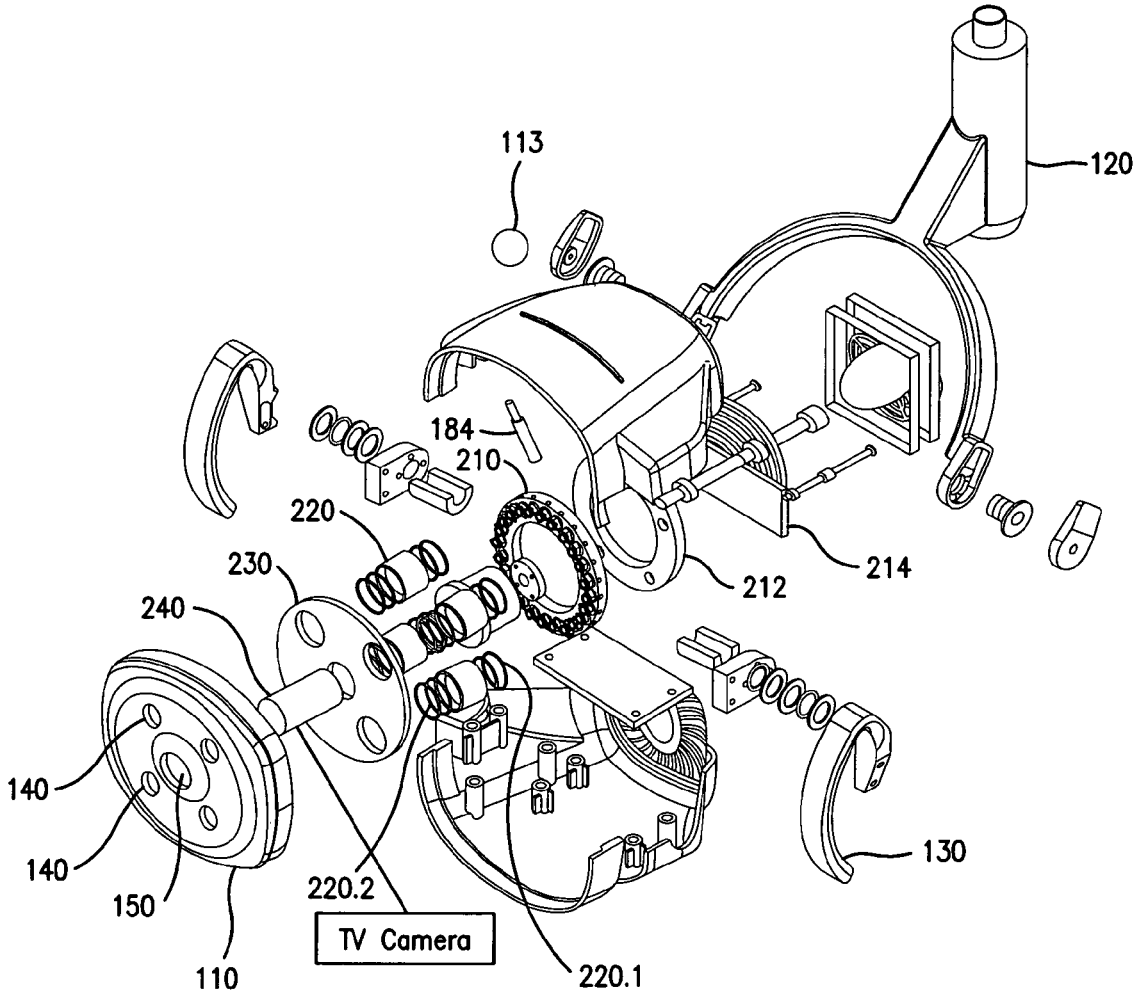
FIG. 2 is an exploded view of the illumination device of FIG. 1.

FIG. 2 illustrates an exploded view of illumination device 100 including mounting assembly 210 which includes a plurality of light sources. A plurality of optical lens or lensing assemblies 220 are oriented with respect to a central axis of the mounting assembly and optically aligned to a corresponding light emitting device to project a desired light through retaining plate 230 and corresponding ports or openings 140 in face plate 110. An additional light source or television camera 240 may be included along the central axis of device 100. Such a centrally positioned light source may provide additional illumination on a distant point through port or hole 150 of face plate 110. Alternatively, a television camera may be used to provide an image of a distant point upon which device 100 is pointed.

Lensing assemblies 220 may include sleeves supporting one of more lenses adapted and/or arranged for projecting an image of the emitting elements of illuminating device 100 to a selected distance. Lensing assemblies 220 may be arranged so that the focal point of the combination of the one or more lenses contained therein is located directly beyond a suitably located light emitting device. In the illustrated embodiment there are four lensing assemblies 220. In alternative embodiments there may be more or fewer lensing assemblies 220 and it would be recognized that the inclusion of more or fewer lensing assemblies 220 may determine the overall size of the illumination device 100. Lensing assemblies 220 are arranged to provide a superimposed defocused images of arrays of emitting elements of light emitting devices at a selected incident area. Such defocusing of images is described in the aforementioned related U.S. patent application Ser. No. 12/074,370 entitled "Illuminating Headlamp Providing Substantially Uniform Illumination." As taught in the aforementioned patent application, by positioning the LEDs in front of the focal point of the corresponding lens assembly a uniform illuminated image is projected at a desired distance. By positioning the light source in front of the lens focal point, a de-focused image is projected from the light source at a remote distance. The super-positioning of a plurality of defocused images at the desired distance provide for a uniformly brighter image. As will be discussed, light source (LED) and lens assemblies 220 are arranged or oriented at angles, with respect to a vertical axis and horizontal axis of device 100, that are appropriate to cause the four illustrated LEDs to each project an unfocused light at a desired distance. The aforementioned related patent application further describes the LEDs being composed of a plurality of LEDs arranged in a LED array. Accordingly, it would be recognized that any reference to the term LED herein shall refer to individual LEDs or LED arrays. Although not shown, it would be recognized that the focal point of the lensing assembly may be adjusted by altering the position or orientation of the at least one lens in lensing assembly 220. For example, the focal point of the lensing assembly may be adjusted by rotation or sliding of the lens(es) within lensing assembly 220 with respect to each other.

Figure 3:
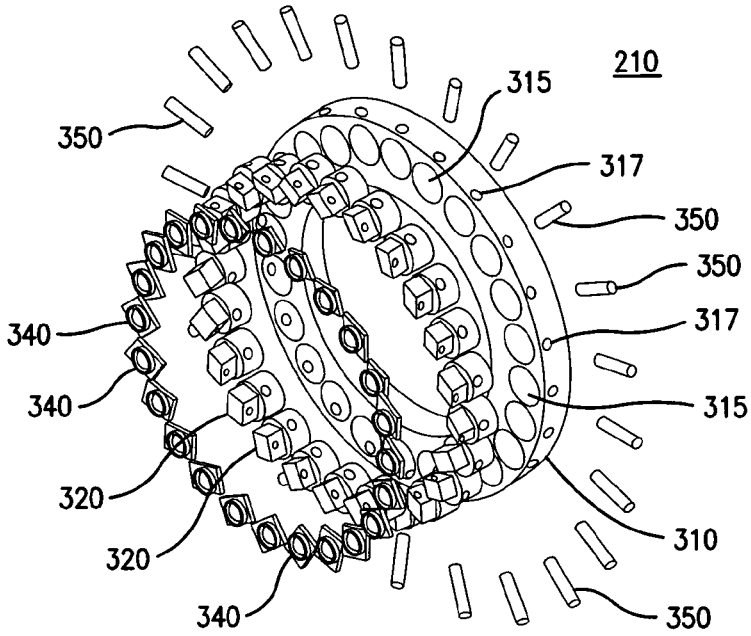
FIG. 3 is a perspective view of an exemplary mounting holder assembly of illumination device of FIG. 1.

FIG. 3 illustrates an exemplary light source mounting assembly 210 for mounting a plurality of light sources. Mounting assembly 210 includes a mounting plate 310 including a plurality of containment envelopes or wells 315 spaced substantially equally about the circumference of plate 310. In this illustrated case, containment envelopes 315 are represented by a plurality of circular openings (wells) that may be created by well-known drilling process. However, it would be recognized by those skilled in the art that the containment envelopes or wells may be of any shape or size. Also illustrated is a plurality of retaining entities 317 along the edge of plate 310.

Mounts 320 have a slip-fit connection with containment envelopes or wells 315 and are held in place by the insertion of keying pin 350 through retaining entity 317. Keying pin 350 extends through plate 310 to engage a matching locking entity 320.1 (see FIG. 4A) in mount 320. LEDs 340 are then mounted on the surface 320.3 of mounts 320. Wells 315 are oriented within mounting plate 310 such that mounts 320 are oriented at an angle suitable for projecting a light at a desired distance from the illumination device 100. Orientation of the LEDs 340 on surface 320.3 is more fully discussed with regard to FIGS. 7 and 8. LEDs 340 may be mounted to surface 320.3 of mounts 320 using known adhesive techniques and need not be described herein.

Figure 4A:
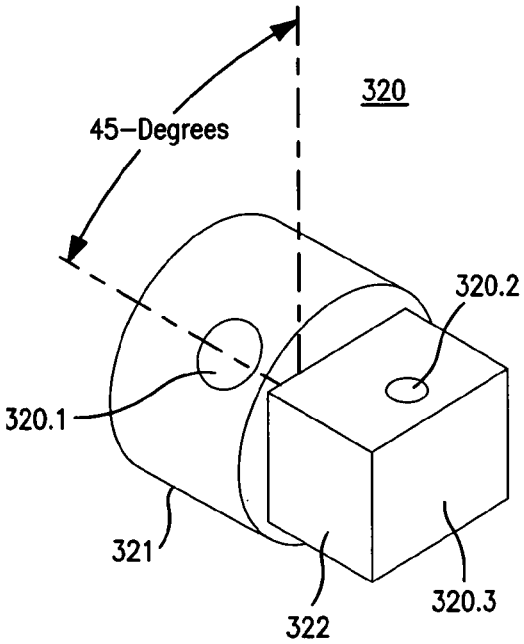
FIGS. 4A and 4B illustrate an exemplary mounting holder in accordance with the illumination device shown in FIG. 1.

FIG. 4A illustrates an exemplary mount 320 in accordance with one aspect of the invention. In this exemplary illustration, mount 320 is composed of a cylindrical section 321 and a substantially cubic or rectangular section 322. Surface 320.3, upon which LED 340 is mounted, is substantially flat. Accordingly, LEDs 340, by virtue of their placement on a substantially flat surface of mount 320, are oriented at an angle suitable for projecting a light at a desired distance from the device 100.

Figure 4B:
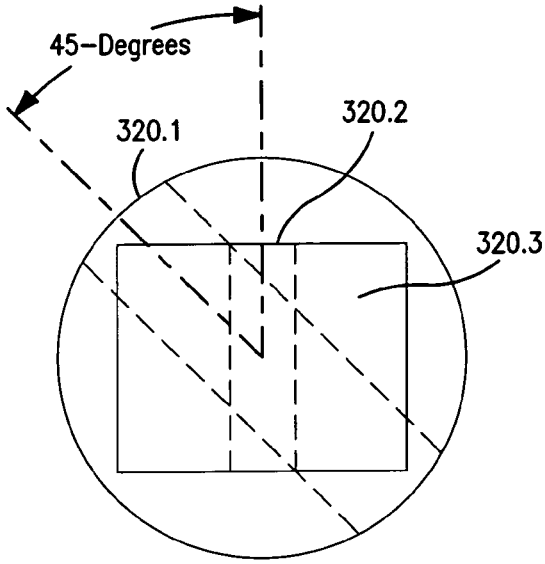
Figure 5A:
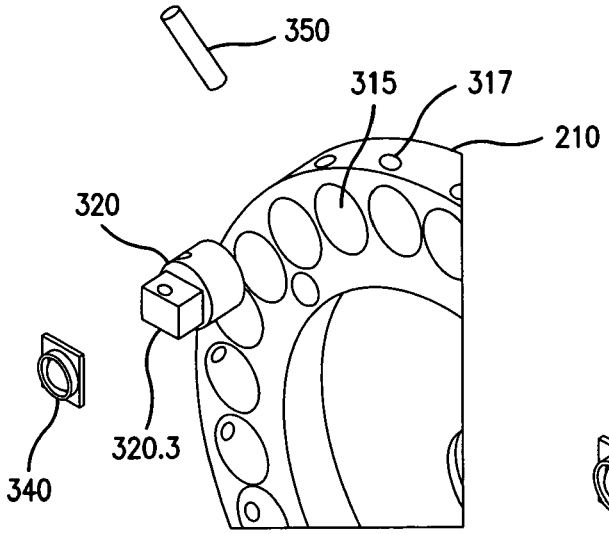
FIGS. 5A-5D is an exploded view of incorporating the mounting holders in the mounting holder assembly shown in FIG. 3.
Figure 5B:
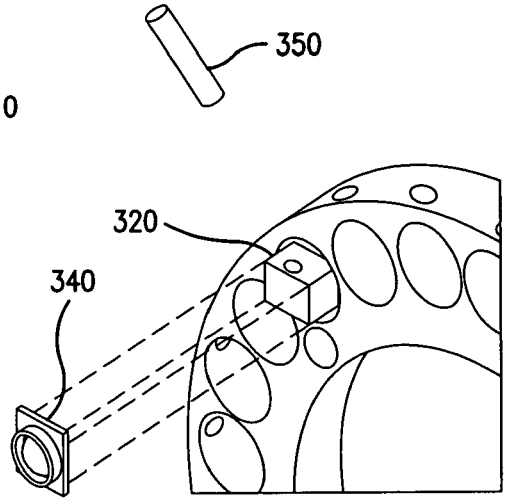
Figure 5C:
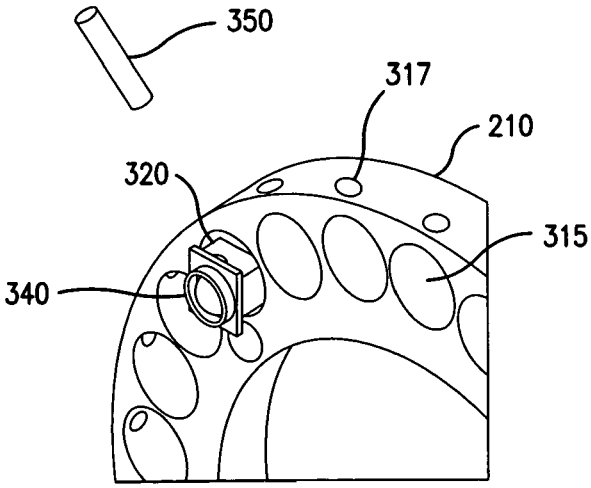
Figure 5D:
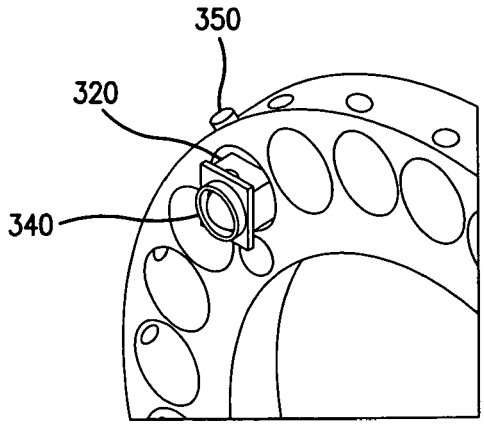

Locking entity 320.1 is, in a preferred embodiment, drilled in cylindrical section 321 and a hole or port 320.2 is drilled in section 322. In this aspect of the invention, the locking entity 320.1 and hole 320.2 are formed with an angular relationship of forty-five (45) degrees. FIG. 4B illustrates a front view of mount 320 showing the angular relationship between locking entity 320.1 and hole 320.2. Hole or port 320.2 may be used to provide electrical connection to LED 340 (not shown) mounted onto surface 320.3

FIGS. 5A-5D illustrate in further detail the insertion of mount 320 in containment envelope 315, the mounting of LED 340 onto surface 320.3 and the insertion of pin 350 into retaining entity 317 and locking entity 320.1 (not shown).

Figure 6:
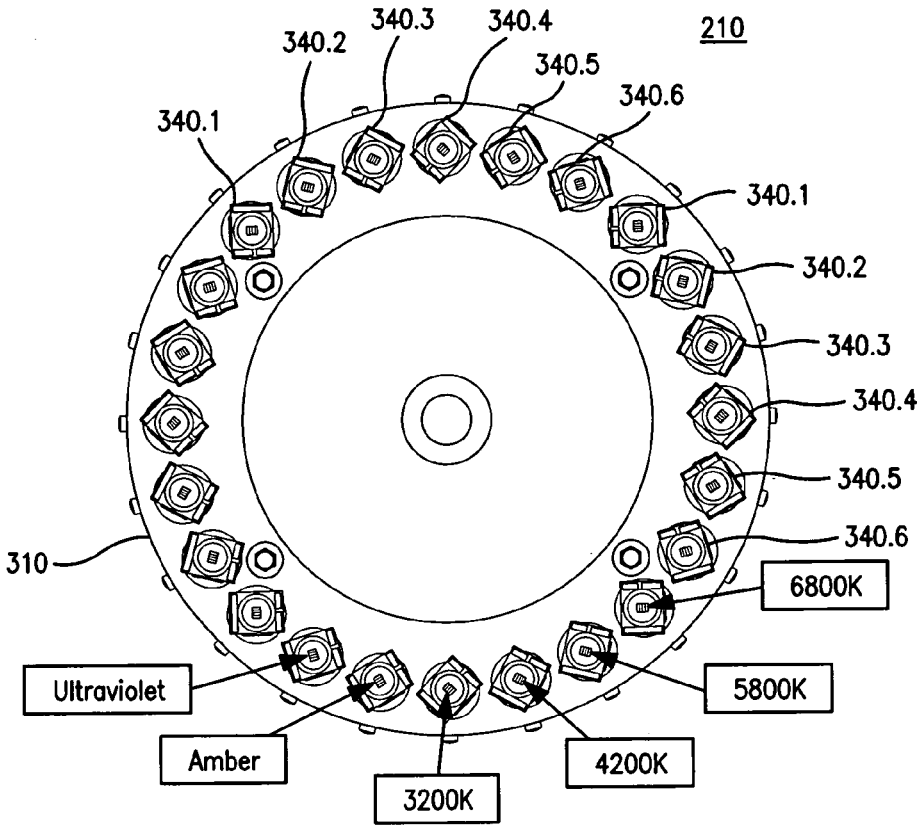
FIG. 6 illustrates a front view of a mounting holder assembly in accordance with one aspect of the present invention.

FIG. 6 illustrates a front view of an exemplary mounting assembly 210 in accordance with the principles of the invention. In this exemplary aspect of the invention illustrated herein, the mounting plate 310 includes 24 containment envelopes or wells 315 positioned around the circumference of plate 310. The 24 wells are divided into four (4) LED sections, each section containing six (6) different LED types 340.1 . . . 340.6. Each LED section contains a first light emitting device 340.1 for providing emissions of a first color characteristic, a second light emitting device 340.2 for providing emissions in a second color characteristic, a third light emitting device 340.3 for providing emissions in a third color characteristic, a fourth light emitting device 340.4 for providing illumination of a fourth color, a fifth light emitting device 340.5 for providing emissions in a fifth color or heat characteristic and a sixth light emitting device 340.6 for providing emission in a sixth color or heat characteristic. Each section includes one LED or LED array from each of the groups of first through sixth light emitting devices 340 and the LEDs 340.*x* within a group are positioned in a same relative position within each section. As each LED or LED array 340 operates in a similar manner reference shall be made to the term "LED 340.*x*" to represent that the discussion herein shall apply to any one of LEDs 340.1-340.6. The terms "color" and "heat" characteristics are well-known terms of art in the optical field, wherein the term "heat" typically refers to a band of wavelengths (white light) and the term "color" refers to a single wavelength or a very narrow range of wavelengths.

In the illustrated example, the LEDs in each section are selected to have a color temperature of 3200° K, 4200° K, 5800° K, and 6800° K and wavelengths of ultraviolet (e.g., 400-500 nm) and amber (e.g., 550 nm). In one aspect, the 6800° K LED may be selected as a Cree LED kit number XREWHT-L1-WC-P4-0-01, the 5800° K LED may be selected as a Cree LED kit no. XREWHT-L1-WG-Q5-0-01, the 4200° K LED may be selected as a Cree LED kit no. XREWHT-L1-5B-25-Q5-01. The amber LED, operating at a wavelength of 550 nm may be selected as a Cree LED kit no. XR7090RD0-I1-001 and the ultraviolet (blue) LED may be selected as a Cree LED kit no. XR7090RY-L1-D5-12-0001. Although devices associated with specific heat or color characteristics are referred to herein, it would be within the knowledge of those practicing in the art to alter or change the light emitting devices to be of a different heat or color characteristic, and such alterations are contemplated to be within the scope of the invention.

As would be appreciated, the particular number of 6 LEDs shown in 4 sections is merely one exemplary embodiment of the invention presented herein by way of example, LEDs 340 may be of the same size and spacing but arranged in a circle on a larger diameter to provide a large number of LEDs or LEDs per LED group or in a circle having a smaller diameter to provide a smaller number of LEDs or LEDs per LED groups. It will be appreciated also that the number of light emitting devices 340 may be adjusted by selection of smaller or larger light emitting devices or by altering the spacing between devices. Light emitting devices 340 may be oriented at a uniform angle radially around the central axis so as to facilitate projection of images of light emitting devices to a selected incident area. Light emitting devices 340 may be light emitting diodes, and may include arrays of diodes, which may be generally rectangular two dimensional diode arrays. Such rectangular two dimensional diode arrays are more fully discussed in the aforementioned related patent application Ser. No. 12/074,370, entitled "Illuminating Headlamp Providing Substantially Uniform Illumination," the contents of which are incorporated by reference herein.

In accordance with the principles of the invention, a subset of light admitting devices 340 arranged around the circumference of assembly 210 may be selectively activated to emit light according of a desired characteristic. For example, a first subset may include only those light emitting devices 340 for providing emissions in the nature of white light having a first-color temperature. A second subset or group may include only those light emitting devices 340 for providing emissions in the nature of white light having a second color temperature. The subset of LEDs may be further selected from any of the six (6) LEDs shown in the exemplary embodiment shown in FIG. 3.

Figure 7:
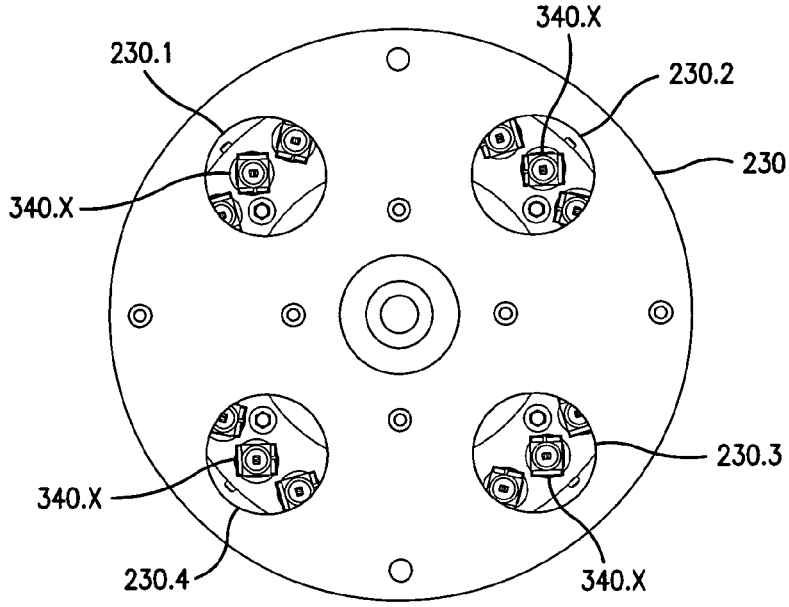
FIG. 7 illustrates a front view of the illumination device shown in FIG. 1.

FIG. 7 illustrates a front view of mounting assembly 210 covered by retaining plate 230. In this illustrated example, each of a selected one of the plurality of LEDs 340 in each of the LED groups, referred to as LED 340.*x*, is visible through holes or ports 230.1-230.4 of retaining plate 230. Retaining plate 230 provides a means for retaining lensing assemblies 220 (not shown) in a proper orientation with respect to face plate 110 (FIG. 1).

Figure 8:
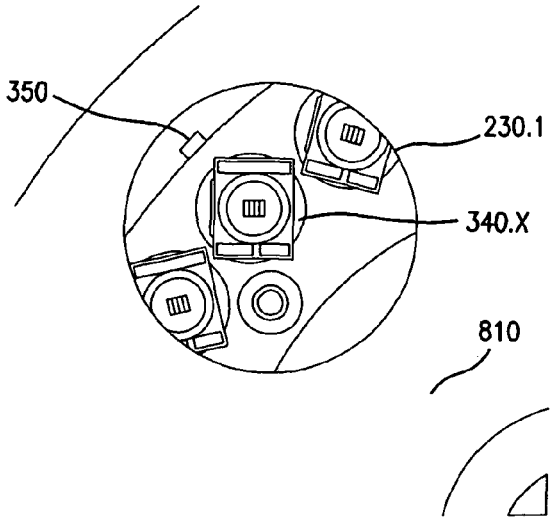
FIG. 8 illustrates detail positioning of the LED in the mounting holder assembly in accordance with one aspect of the invention.

FIG. 8 illustrates in further detail the positioning of LED 340.*x* with respect to the projecting hole 230.1. In this illustrated aspect of the invention, LED 340.*x* is mounted at an angle of substantially forty-five (45) degrees with respect to pin 350. To achieve this orientation, the LED 340*x* may be mounted either horizontally or vertically with respect to the mounting surface 320.3. As the surface 320.3 is substantially square, the orientation of LED 340.*x* is merely one of a design choice and different orientations of LED 340.*x* or LED arrays are contemplated herein.

Figure 9:
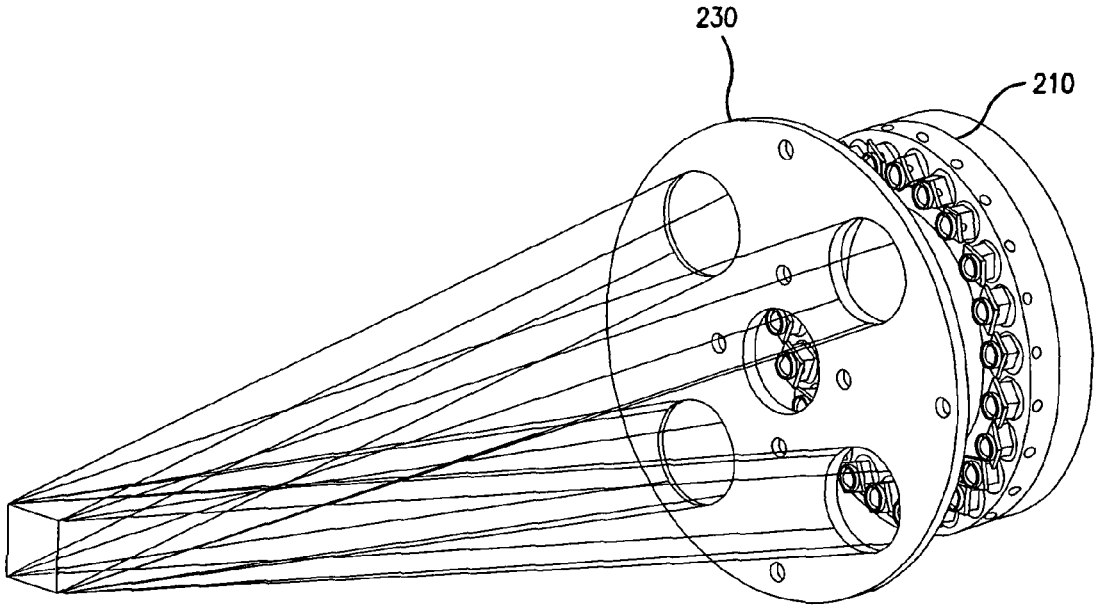
FIG. 9 illustrates a typical light projection of the device shown in FIG. 1.

FIG. 9 illustrates an exemplary pattern of light projected from the selected four LEDs shown. In this case, the projected light pattern is substantially square as each LED provides a uniformly bright defocused light at the desired distance. The superposition of each of the uniformly defocused light from each LED 340.*x* creates the substantially square image.

Figure 10A:
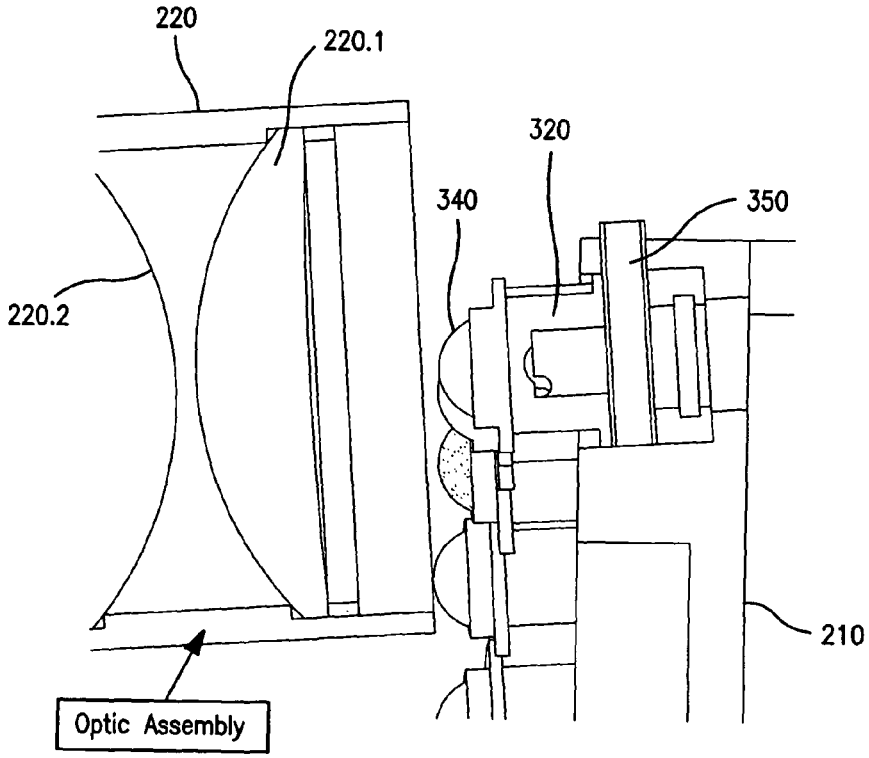
FIGS. 10A and 10B illustrates a cross-sectional view of the device shown in FIG. 9.

FIG. 10A illustrates a cross-sectional view of lens assembly 220 and mounting assembly 210 in accordance with the principles of the invention. FIG. 10A illustrates lens assembly including convex lens 220.1 and 220.2 and LED 340 positioned along a central axis (not show) of lens assembly 220. Although lens 220.1 and 220.2 are represented as convex lens, it would be within the knowledge of those skilled in the art to replace such lens with other types of lens, e.g., spherical or aspheric lens, in order to create a desired lens assembly characteristic, e.g., focal point, and such alterations are considered to be within the scope of the invention. The lens may be made of a plastic or a glass composition, which may include or not including a coating, i.e., reflective coating, e.g., $MgF_2$. Furthermore, the focal point of the lensing assembly 220 may be adjusted by rotating or sliding the lens(es) within the lensing assembly and/or with respect to one another, when two or more lens are contained within lensing assembly 220. Further illustrated is an angular orientation of LED 340 vertically (θ) (depression angle) to project a light from LED 340 onto a distant point. Although not shown, it would be appreciated that LED 340 is further oriented horizontally (Φ) toward a center line of assembly 210 and mounting plate 310. Such horizontal angle orientation is referred to as a toe-in angle. The combination of depression angle and a toe-in angle creates a compound angle that orients LED 340 in a position that allows for a projection of a defocused light at a desired distance. In an exemplary embodiment of the invention, an angle of 3.95 degrees, both horizontally and vertically, is selected to enable convergence of a light projected from each of LED 340 at a distance of twenty-two (22) inches from face plate 110 (see FIG. 1). In this exemplary embodiment, wells 315 are formed in mounting plate 310 at an angle of 3.95 degrees vertical depression and 3.95 degrees horizontal toe-in. In another aspect of the invention, the surface 320.3 may be machined at the appropriate compound angle so the LEDs 340 may be oriented to project the light at the remote distance. In this aspect of the invention, the wells 315 are formed substantially perpendicular in mounting plate 310 and the placement of the mounts 320 with a surface shaped at the desired angle provides for the required orientation of LEDs 340.

Figure 10B:
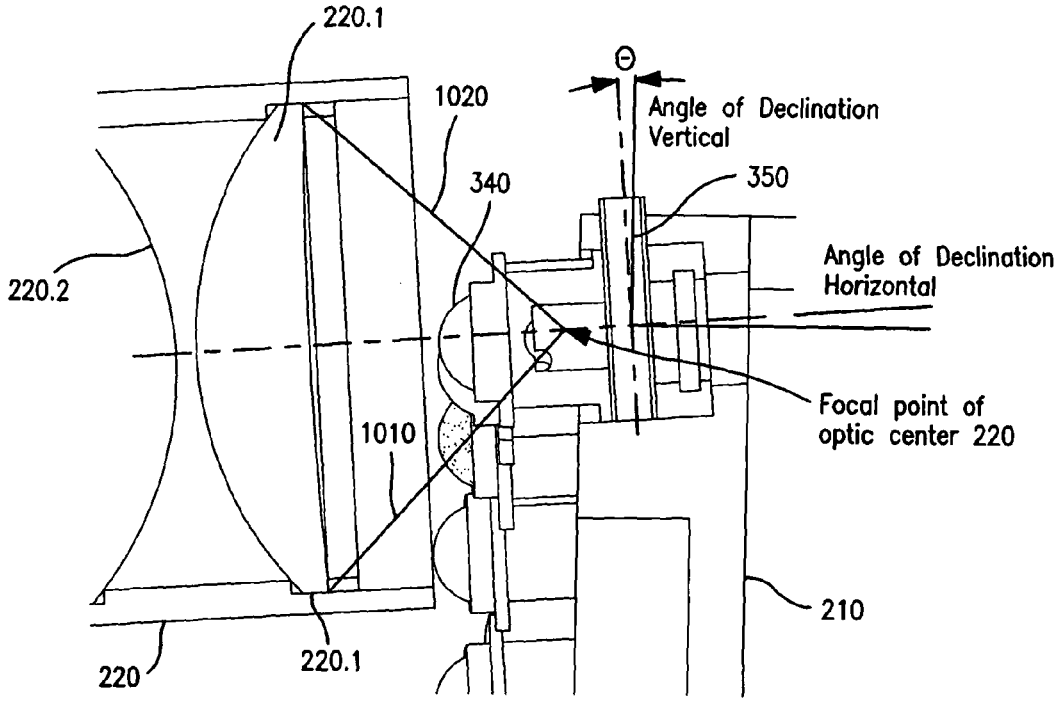

FIG. 10B illustrates a cross-sectional view of mounting assembly 210 and lens 220, similar to that shown in FIG. 1A. FIG. 10B illustrates the positioning of LED 340 with respect to lens assembly 220 to create a projection of a defocused image at a known distance from face plate 110. As shown, LED 340 is positioned in front of the focal point of lens assembly 220, which is represented by the intersection of ray lines 1010, 1020.

Figure 11:
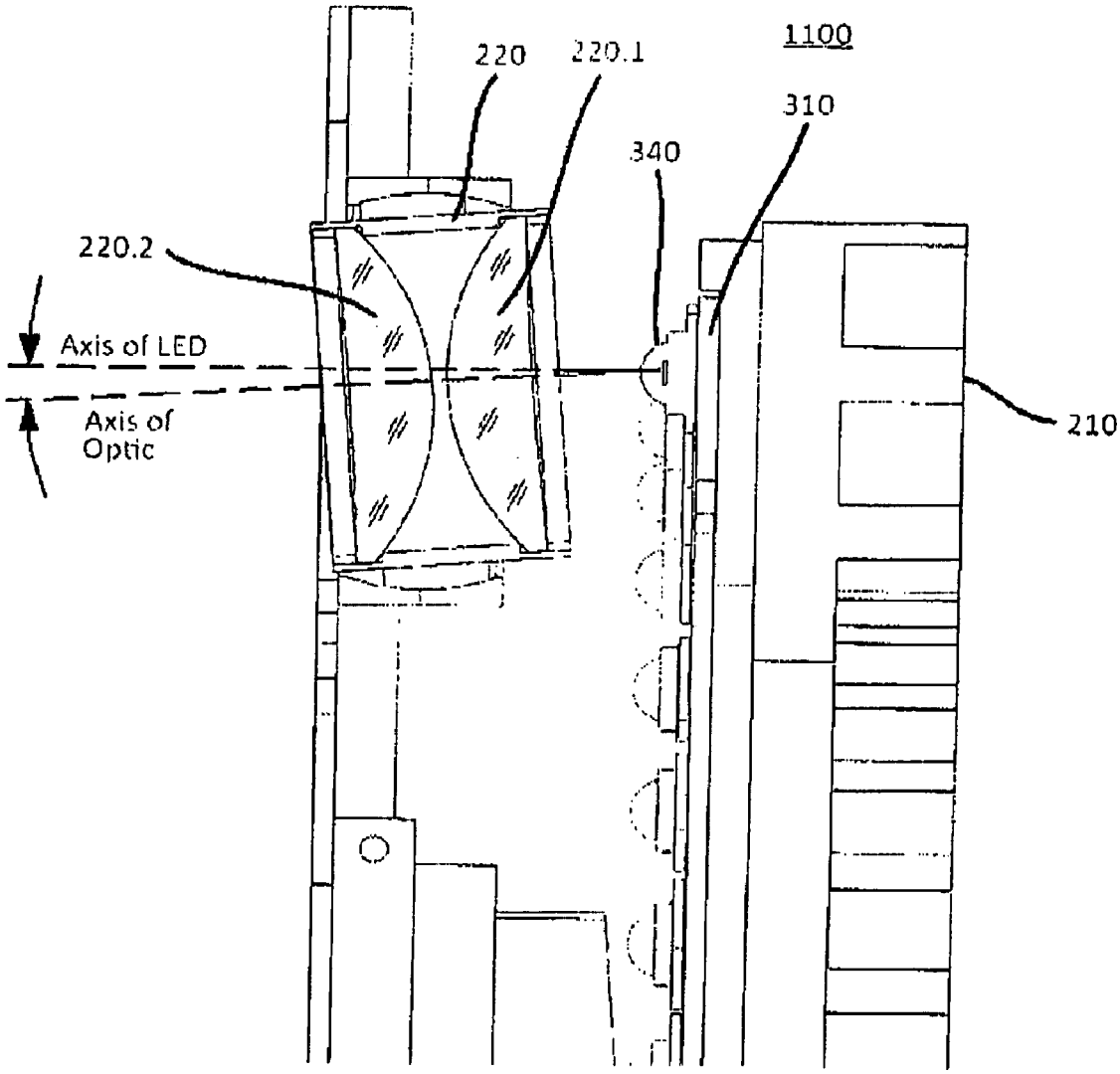
FIG. 11 illustrates a cross-sectional view of a second aspect of the invention claimed.

FIG. 11 illustrates a second aspect of the exemplary embodiment of the invention described herein. In this second aspect of the invention, lens assembly 220 includes convex lens 220.1 and 220.2 and LED 340 is positioned along a physical central axis of lens assembly 220 (i.e., axis of LED). Although lens 220.1 and 220.2 are represented as convex lens, it would be within the knowledge of those skilled in the art to replace such lens with other types of lens, e.g., spherical or aspheric lens, in order to create a desired lens assembly characteristic, e.g., focal point, and such alterations are considered to be within the scope of the invention. The lens may be made of a plastic or a glass composition, which may include or not including a coating, i.e., reflective coating, e.g., $MgF_2$. Furthermore, the focal point of the lensing assembly 220 may be adjusted by rotating or sliding the lens(es) within the lensing assembly and/or with respect to one another, when two or more lens are contained within lensing assembly 220. Further illustrated is a substantially flush orientation of LED 340 mounted onto mounting plate 310. LED 340 may be mounted directly to mounting plate 310 or may be positioned on surface 320.3 of mounts 320 or may be mounted on a circuit board that is mounted to the mounting plate 310. Accordingly, when mounting directly onto mounting plate 310, the need for mounts 320 is removed as the surface mounting of LEDs 340 onto mounting plate 310 provides for a desired orientation of LEDs 340 with respect to lensing assembly 220. Similarly, when mounted on a circuit board the need of drilling wells within the mounting plate 310 is removed as the surface mounting of the circuit board on the mounting plate 310 provides the desired orientation of the LEDs 340. As would be recognized in the art, LEDs 340 may be surface mounted onto mounting plate 310 using well-known adhesives, which need not be discussed in detail herein. In another aspect, the LEDs may be mounted on the circuit board using, for example, a wave soldering technique. However, when using mountings 320, the wells 315 are formed substantially perpendicular in mounting plate 310 and the placement of the mounts 320 having a substantially flat surface provides for the desired orientation of LEDs 340.

As shown in FIG. 11, the optical axis of the projection of light from LED 340 is substantially perpendicular to the mounting plate 310. To provide for a convergence of the light from each of the active LEDs 340, (see for example FIG. 9) the optical axis of lensing assembly 220 is oriented at a known angle with respect to the light projected from a corresponding LED 340 (i.e., axis of optics). Contrary to the configuration shown in FIG. 10A, wherein the optical axis and the physical axis of lens assembly 220 coincide, in this embodiment of the invention, the optical axis and the physical axis of lens assembly 220 are offset by a known angle. For in one aspect of the invention, a defocused image may be projected at a distance of 22 inches when the optical axis of lens assembly 220 is oriented at an angle of 3.77 degrees with regard to the light projected from a corresponding LED 340, wherein the angle is determined as a function of the projected distance and the distance of the LEDs from a central axis of the device (see FIG. 1). In second embodiment of the invention the distance of the LEDs from the central axis is greater than that of the distance of the LEDs shown in FIG. 10*a*. Hence, the known angle is reduced. Determination of the angles may be determined by those skilled in the art using well-known trigonometric equations.

In one aspect of the invention, optical angle of the lensing assembly 220, with respect to the projection of light from the light emitting source may be determined based on the distance of the remote point upon which defocused light is to be projected, the distance of the light sources from a central axis of the mounting assembly and the orientation of the ports 140. For example, when ports 140 are shown as in FIG. 1, then the known angle is a compound angle that requires an angle of depression and toe-in angle to project light a the desired remote point. For example, the angle of depression and the toe-in angle may each be set at 3.31 degrees to produce a known angle of 3.77 degrees. However, in another aspect of the invention, wherein ports 140 of FIG. 1 are shifted by forty-five (45) degrees so that ports 140 are oriented on a vertical and a horizontal axis, then the known angle of the optical axis of the lensing assembly is a simple an angle of depression, i.e., 3.77 degrees depression and zero (0) degrees toe-in.

Returning to FIGS. 1 and 2, in the illustrated embodiment, LEDs 340 are mounted rigidly on the mounting assembly 210, which serves as a carrier. Electrical contacts (not shown) may be provided on back plate of mounting assembly 210. Corresponding electrical contacts may be provided on an interior surface of plate 212. Contacts are provided on contact plate 212 so that at least one LED in each group in each section is energized at any one time. A voltage is maintained on plate 214, which is applied to LED 340.*x* through plate 212. In various embodiments, a single contact may be provided to energize all LEDs in each group. In another aspect, each contact may energize the LEDs for two groups, in which case corresponding additional contacts are provided. Rotation of contact plate 212 causes the closing of a circuit permitting the LED of each grouping to be located in alignment with the lensing assembly 220 associated with the groupings to be activated. In an embodiment, manual movement of mounting assembly 210 may be accomplished, such as by manual manipulation of handle 113. Handle 113 may be mechanically coupled to plate 212. Handle 113 may, for example, be rigidly coupled to plate 212. Motion of plate 212 (and assembly 210) may be constrained by a curving slot 182 (FIG. 1). Rod 184 is coupled rigidly to plate 212 and extends to slot 182. The length of the curving slot 182 is sufficient for manual rotation of contact plate 212 to plate 214 to permit alignment of any of the LEDs 340 in each grouping with corresponding contact in corresponding lensing assembly 220.

Proper alignment of LEDs 340 with lens 220 and plate 214 may be obtained by a suitable mechanism. In an embodiment, arrays of suitably spaced ball plungers (not shown) may be mounted on one of the rotatable elements, i.e. the mounting plate 310, the contact plate 212, or stationary element, with the mating one of the ball plungers and wells mating to one another. Thus, an array of ball plungers faces an array of wells, or an array of wells face an array of ball plungers. The position of ball plungers and wells may be arranged so that when a ball plunger is received in a well, appropriate alignment is obtained between a subset of LEDs 340 and a corresponding lensing assembly 220. When a user manually adjusts handle 113, the user can readily feel when a ball plunger is received in a well. The outside surface of the housing 105 may bear markings identifying the subset or group of LEDs associated with each location in the travel of handle 113.

In another embodiment, motors, such as one or more servo motors, may be mounted in device 100 and operably coupled with mounting ring 210 and contact plate 212 so as to rotate mounting ring 210 to achieve proper orientation with lens assembly 220. In an embodiment, a suitably programmed processor may be coupled to one or more user inputs, so that the user may select LED group. The user inputs may include switches or dials on housing 105 coupled by wired connection. In an embodiment, the user inputs may include switches or dials on housing 105 incorporating a wireless transmitter, such as a radio frequency, ultrasound or infrared transmitter, coupled to a suitable processor.

In another embodiment, rather than mechanical switching, electronic switching may be provided for selecting LEDs for activation. Lensing assemblies 220 may be permanently aligned with each LED 340. In this case, face plate 110 includes an opening for each of the LEDs 340. Upon activation, via wired or wireless user inputs, suitable switches may be closed to activate selected LEDs such as LEDs of one group. In another embodiment, a processor may provide for pulsewidth modulation using LEDs of different colors, for example, to obtain an appearance of various colors. By way of example, red, blue and green LEDs may be employed using suitable pulsewidth modulation. Such modulation is well known, for example, in connection with color display technology.

While the foregoing invention has been described with reference to the above described embodiments, various modifications and changes can be made without departing from the spirit of the invention. Accordingly, all such modifications and changes are considered to be within the scope of the invention.

What is claimed:

1. An illumination device for projecting a substantially uniform light at a remote distance, said device comprising:

a mounting assembly divided into a plurality of sections, each section comprising:

a plurality of light emitting sources arranged substantially equi-distant along a circumference of said assembly, said light emitting sources projecting a light image substantially perpendicular to said mounting assembly;

an contact plate connected via a central axis with, and fixed to, said mounting assembly, said contact plate providing an electrical contact to each of said light emitting devices;

a plurality of lensing assemblies equal in number to said plurality of sections, axially aligned with said mounting assembly, each lensing assembly aligned with a select one of said light emitting sources in a corresponding section of said mounting assembly wherein said select light emitting source is positioned in front of a focal point of said lensing assembly, each lensing assembly comprising at least one optically transparent lens determining said lensing assembly focal point, said lensing assemblies optically oriented at a known angle with respect to said light projected from a corresponding one of said light emitting source; and means for shifting said contact plate and mounting assembly to align a select one of said light emitting devices with said lensing assembly.

2. The device of claim 1, wherein said light emitting devices are selected from the group consisting of: LEDs and LED arrays.

3. The device of claim 2, wherein said light emitting devices are selected from the group consisting of devices having: color temperatures of 2400-8000° K and wavelengths of 300-600 nm.

4. The device of claim 1, further comprising:

an electrical contact plate, axially contacted, via said central axis, to said contact plate, said electrical contact plate proving an electrical source to said select one light emitting device aligned with said lensing assembly.

5. The device of claim 1, wherein said mounting assembly comprises:

a plurality of wells arranged around the circumference of said mounting assembly, each of said wells retaining a mounting upon which said light emitting sources is attached.

6. The device of claim 5, wherein said wells are arranged in said mounting assembly at an angle substantially perpendicular to said mounting assembly.

7. The device of claim 5, wherein said mounting is formed with a facing surface substantially perpendicular to said mounting assembly.

8. The device of claim 1, wherein said known angle has at least one of a known angle of depression and a known toe-in angle, wherein said angle of depression and said toe-in angle are determined as a function of the remote distance, a distance of said LEDs from said central axis and an orientation of said lensing assemblies about said central axis.

9. The device of claim 1, wherein said means for shifting said contact plate and mounting assembly is selected from the group consisting of: manual, mechanical, electrical and electric-mechanical.

10. The device of claim 1, further comprising:

a device mounted along said central axis, said device selected from the group consisting of: a television camera and a light emitting source.

11. The device of claim 1, wherein said lensing assembly further comprising:

means for adjusting said focal point of said lensing assembly.

12. The device of claim 11, wherein said adjustment means of said lensing assembly is selected from the group consisting of: rotary and sliding.

13. An illumination device for projecting a substantially uniform light at a remote distance, said device comprising:

a mounting assembly divided into a plurality of sections, each section comprising:

a plurality of light emitting sources arranged substantially equi-distant along a circumference of and mounted onto said mounting assembly, said light emitting sources projecting a light image substantially perpendicular to said mounting assembly;

a contact plate connected via a central axis with, and fixed to, said mounting assembly, said contact plate providing an electrical contact to each of said light emitting devices;

a plurality of lensing assemblies equal in number to said plurality of sections, axially aligned with said mounting assembly, each lensing assembly aligned with a select one of said light emitting sources in a corresponding section of said mounting assembly wherein said select light emitting source is positioned in front of a focal point of said lensing assembly, each lensing assembly comprising at least one optically transparent lens determining said lensing assembly focal point, said tensing assemblies optically oriented at a known angle with respect to said light projected from a corresponding one of said light emitting source; and means for shifting said contact plate and mounting assembly to align a select one of said light emitting devices with said lensing assembly.

14. The device of claim 13, wherein said light emitting sources are mounted to said mounting assembly with an adhesive.

15. The device of claim 13, wherein said light emitting sources are mounted on a circuit board and said circuit board is attached to said mounting assembly.

16. The device of claim 15, wherein said light emitting sources are wave-soldered onto said circuit board.

17. The device of claim 15, wherein said circuit board is attached to said mounting using at least one of: an adhesive and a mechanical attachment.

* * * * *